US009416635B2

(12) United States Patent
Hekelaar

(10) Patent No.: US 9,416,635 B2
(45) Date of Patent: Aug. 16, 2016

(54) SYSTEM AND METHOD OF CUTTING AND REMOVING CASINGS FROM WELLBORE

(71) Applicant: Smith International, Inc., Houston, TX (US)

(72) Inventor: Stephen Hekelaar, Spring, TX (US)

(73) Assignee: Smith International, Inc., Houston, TX (US)

( * ) Notice: Subject to any disclaimer, the term of this patent is extended or adjusted under 35 U.S.C. 154(b) by 596 days.

(21) Appl. No.: 13/949,735

(22) Filed: Jul. 24, 2013

(65) Prior Publication Data

US 2014/0027117 A1 Jan. 30, 2014

Related U.S. Application Data

(60) Provisional application No. 61/675,074, filed on Jul. 24, 2012.

(51) Int. Cl.

| | |
|---|---|
| ***E21B 31/20*** | (2006.01) |
| ***E21B 43/112*** | (2006.01) |
| ***E21B 29/00*** | (2006.01) |
| ***E21B 31/107*** | (2006.01) |

(52) U.S. Cl.

CPC ..... *E21B 43/112* (2013.01); *E21B 29/00* (2013.01); *E21B 31/107* (2013.01); *E21B 31/20* (2013.01)

(58) Field of Classification Search

CPC ..... E21B 31/12; E21B 31/20; E21B 31/107; E21B 29/00; E21B 43/112

See application file for complete search history.

(56) References Cited

U.S. PATENT DOCUMENTS

| | | | | |
|---|---|---|---|---|
| 2,174,076 | A * | 9/1939 | Bowen | E21B 31/12 294/86.17 |
| 2,184,681 | A * | 12/1939 | Osmun | E21B 31/12 294/102.1 |
| 2,539,039 | A * | 1/1951 | Siracusa | E21B 31/20 294/86.16 |
| 4,706,745 | A | 11/1987 | Bishop et al. | |
| 4,877,085 | A * | 10/1989 | Pullig, Jr. | E21B 31/20 166/98 |
| 4,969,514 | A | 11/1990 | Morris et al. | |
| 5,253,710 | A * | 10/1993 | Carter | E21B 31/20 166/216 |
| 5,580,114 | A * | 12/1996 | Palmer | E21B 23/04 294/86.15 |
| 5,791,712 | A * | 8/1998 | Hawn | E21B 31/20 294/86.15 |
| 6,758,267 | B1 * | 7/2004 | Sollesnes | E21B 31/20 166/98 |
| 7,762,330 | B2 | 7/2010 | Saylor, III et al. | |
| 8,122,960 | B2 | 2/2012 | MacDonald et al. | |
| 2009/0151951 | A1 * | 6/2009 | Erkol | E21B 31/20 166/301 |
| 2012/0186817 | A1 | 7/2012 | Gibson et al. | |
| 2012/0285684 | A1 * | 11/2012 | Crow | E21B 31/20 166/298 |

* cited by examiner

OTHER PUBLICATIONS

Notification of transmittal of the International Search Report and the Written Opinion of the International Searching Authority issued Oct. 10, 2013 in corresponding International Application No. PCT/US2013/051838 (10 pages).

*Primary Examiner* — Yong-Suk (Philip) Ro

(57) ABSTRACT

A spearing device for removing casing from wellbore includes a top sub, a bottom sub, and a mandrel coupled to the top and bottom subs. The device includes a grapple having a corrugated inner surface corresponding to a corrugated portion of the mandrel and an outer surface including wickers for engaging an interior surface of the casing. A piston is disposed within the mandrel and operatively coupled to the grapple. A spring operates with the piston and biases the grapple toward a collapsed position. The grapple axially and rotationally moves along the corrugated outer surface of the mandrel. The grapple expands and collapses in response to axial movement relative to the mandrel. The piston compresses the spring and axially moves and expands the grapple in response to increases in hydraulic pressure. In response to subsequent decreases in hydraulic pressure, the spring decompresses and axially moves and collapses the grapple.

21 Claims, 8 Drawing Sheets

SYSTEM AND METHOD OF CUTTING AND REMOVING CASINGS FROM WELLBORE

CROSS-REFERENCE TO RELATED APPLICATIONS

This application, pursuant to 35 U.S.C. §119, claims priority to U.S. Provisional Application No. 61/675,074, filed on Jul. 24, 2012, which is incorporated herein by reference in its entirety.

BACKGROUND

In oil and gas exploration and development operations, it is often desirable to remove casing which has previously been set in the wellbore. Casing removal requires that the casing string first be severed, and the free end then pulled to the surface, to remove the severed portion.

Conventional apparatus and techniques for extraction of well casing typically involve the use of multiple trips to move cutting and extracting equipment downhole. Thus, in removal operations a cutting device is first lowered into the wellbore to cut the casing at a desired depth after which time the cutting device is returned to the surface. A spearing device is then lowered inside the well and engaged to the free end of the casing. Once the free end of the casing is engaged, an attempt is then made to recover the casing by pulling, or, in the case where jars are used, by a combination of pulling and jarring. If these attempts to remove the casing are unsuccessful, the spear assembly is removed from the wellbore and the cutting device reattached to the tool string to sever the casing at a point above the original cut. The pulling/jarring process is then repeated until the casing is recovered.

Such prior art apparatuses and techniques for retrieving well casing are time consuming and costly. This time and expense is a result of the utilization of separate cutting and extraction tools, which are typically run downhole independently. Even when casing is retrieved without the need to complete a second cut of the casing, at least two trips are necessary for a complete cutting and retrieval operation. When a significant length of casing is extracted, considerable rig time must be used to move the tools downhole to the site of the cut. Time and expense are therefore increased when multiple cuts are necessary to retrieve the casing.

In certain operations, casing cutting may be required when performing slot recovery operations. During slot recovery, the object is to construct a new well with new barriers from a previously used slot while shutting off all communication with an old reservoir. Cutting and pulling casing may be restricted due to cement behind production casing or barite settling from drilling fluid in the production casing annulus. Such slot recovery operations may thus require the cutting and removal of multiple sections of casing from a wellbore. Because slot recovery operations often involve cutting a casing segment in a first trip and pulling the cut casing in a second trip, such operations are often time consuming and expensive.

SUMMARY OF THE CLAIMED EMBODIMENTS

In one aspect, embodiments disclosed herein relate to a spearing device for use in removing casing from a wellbore. The spearing device may include: a top sub; a bottom sub; a mandrel coupled to the top sub and bottom sub and having an outer surface, at least a portion of which is corrugated. The spearing device also includes: a grapple including one or more grapple members having a correspondingly corrugated inner surface and at least a portion of an outer surface of the grapple members including wickers for engaging an interior surface of the casing, wherein the grapple is configured to (i) axially and rotationally move along the corrugated outer surface of the mandrel and (ii) expand and collapse the grapple members responsive to axial movement relative to the mandrel; a piston slidably disposed within the mandrel and operatively connected to the grapple; and a spring operative with the piston and biasing the grapple toward a collapsed position. Responsive to an increase in hydraulic pressure, the piston compresses the spring and axially moves the grapple, expanding the grapple members. Responsive to a subsequent decrease in hydraulic pressure, the spring decompresses and axially moves the grapple, collapsing the grapple members.

In another aspect, embodiments disclosed herein relate to a downhole tool for cutting and removing casing from a wellbore. The tool may include: a cutting device disposed on a tool string and configured to make at least one casing cut; and, a spearing device disposed on the tool string and configured to engage and remove casing cut by the at least one cutting device from the wellbore. The spearing device may include: a top sub; a bottom sub; a mandrel coupled to the top sub and bottom sub and having an outer surface, at least a portion of which is corrugated; a grapple including one or more grapple members having a correspondingly corrugated inner surface and at least a portion of an outer surface of the grapple members including wickers for engaging an interior surface of the casing, wherein the grapple is configured to (i) axially and rotationally move along the corrugated outer surface of the mandrel and (ii) expand and collapse the grapple members responsive to axial movement relative to the mandrel; a piston slidably disposed within the mandrel and operatively coupled to the grapple; and a spring operative with the piston and biasing the grapple toward a collapsed position. Responsive to an increase in hydraulic pressure, the piston compresses the spring and axially moves the grapple, expanding the grapple members. Responsive to a subsequent decrease in hydraulic pressure, the spring decompresses and axially moves the grapple, collapsing the grapple members.

In another aspect, embodiments disclosed herein relate to a method of removing casing from a wellbore. The method may include: disposing a downhole tool assembly in a wellbore, the downhole tool assembly including a first cutting device and a first spearing device. The spearing device may include: a top sub; a bottom sub; a mandrel coupled to the top sub and bottom sub and having an outer surface, at least a portion of which is corrugated; a grapple including one or more grapple members having a correspondingly corrugated inner surface and at least a portion of an outer surface of the grapple members including wickers for engaging an interior surface of the casing, wherein the grapple is configured to (i) axially and rotationally move along the corrugated outer surface of the mandrel and (ii) expand and collapse the grapple members responsive to axial movement relative to the mandrel; a piston slidably disposed within the mandrel and operatively coupled to the grapple; and a spring operative with the piston and biasing the grapple toward a collapsed position. Responsive to an increase in hydraulic pressure, the piston compresses the spring and axially moves the grapple, expanding the grapple members. Responsive to a subsequent decrease in hydraulic pressure, the spring decompresses and axially moves the grapple, collapsing the grapple members. The method may also include: activating the first cutting device; cutting a first casing segment; deactivating the first cutting device; activating the first spearing device; engaging the first spearing device with the first casing segment; removing the first casing segment from the wellbore.

This summary is provided to introduce a selection of concepts that are further described below in the detailed description. This summary is not intended to identify key or essential features of the claimed subject matter, nor is it intended to be used as an aid in limiting the scope of the claimed subject matter.

DETAILED DESCRIPTION

In one aspect, embodiments disclosed herein relate to methods and apparatuses for cutting and retrieving easing from a wellbore. More specifically, methods and apparatuses disclosed herein relate to removing casing from a wellbore by making multiple casing cuts, and retrieving the casing joints in a well slot recovery operation. More specifically still, methods and apparatuses disclosed herein relate to making multiple casing cuts and retrieving multiple cut casing joints from a wellbore in a single trip.

The methods and apparatus disclosed herein include downhole tool assembly designs that may be used in the cutting and removing of casing segments from a wellbore. In accordance with embodiments disclosed herein, such operations, often referred to by those of ordinary skill in the art as slot recovery applications, include the use of a downhole tool capable of cutting casing segments, engaging the cut segments, freeing the segments, and then removing the segments from the wellbore in a single trip. Because multiple casing cuts may increase the efficiency of the operations, methods for activating and/or deactivating multiple downhole tools will be discussed below in detail.

Figure 1:
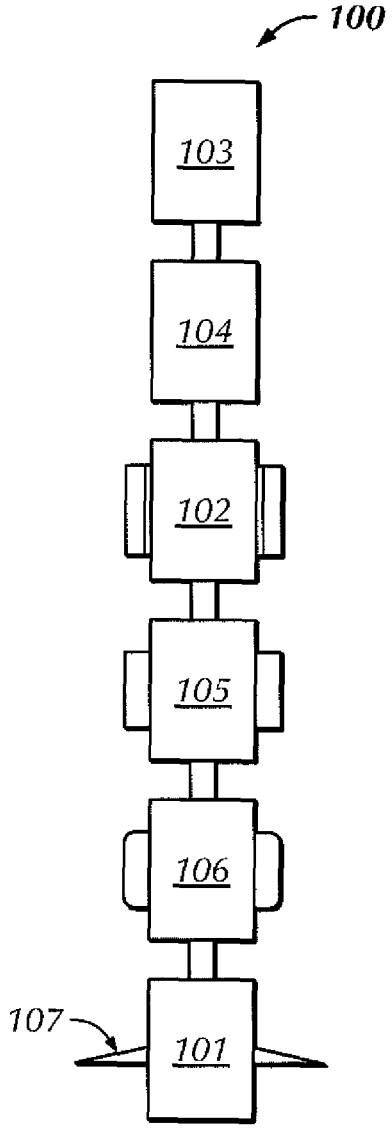
FIG. 1 is a schematic representation of a downhole tool assembly according to embodiments of the present disclosure.

Referring to FIG. 1, a schematic representation of a fishing tool assembly 100 according to embodiments of the present disclosure is shown. Fishing tool assembly 100 includes a cutting device 101, a spearing device 102, and a jarring device 103. Generally, cutting device 101 may be any type of cutting device capable of cutting cemented/uncemented casing known in the art. Spearing device 102 will be described in detail below. Jarring device 103 may include various types of jarring devices known in the art. Fishing tool assembly 100 may also include one or more additional components that may facilitate the slot recovery operation. The other components illustrated in FIG. 1 include a jarring device 104, a packer 105, and a stabilizer 106. Those of ordinary skill in the art will appreciate that, depending on the requirements of the slot recovery operation, multiple cutting devices 101, spearing devices 102, packers 105, stabilizers 106, and other components, such as jar accelerators (not shown), may be used. Such alternative configurations of downhole tool assembly 100 will be discussed in detail below.

Generally, as noted above, cutting device 101 may include any type of cutting device capable of cutting casing known in the art. Such cutting devices typically include a plurality of arms 107 that may be actuated to extend from the body of the cutting device to engage casing. Typically, cutting devices include a plurality of cutting elements, teeth, or inserts disposed on the arms, such that upon actuation, the cutting elements contact the casing. Examples of cutting device actuation may include, spring loaded knives, expandable arms and/or blades with cuttings elements disposed thereon, and other cuttings devices known to those of ordinary skill in the art. As the tool string rotates, including rotation of the cutting device 101, the cutting elements on arms 107 contact the casing and cut the casing to a depth defined by the extension of arms 107 and/or cutting elements. Thus, those of ordinary skill in the art will appreciate that a depth of cut into the casing may be controlled by limiting the extension of the arms and/or the protrusion from the arms of associated cutting elements. Depending on the thickness of the casing being cut, it may be beneficial to limit the depth of cut into the casing to, for example, 0.25 inches more than the casing thickness. In still other operations, it may be beneficial to decrease the depth of cut to an alternate depth, such as, for example, the thickness of the casing or a specified depth for the specific operation. Such depth of cut limits may find application in operations where sequentially smaller casing segments are disposed within the same region. Because the depth of cut may be limited, an engineer may elect to cut into a first casing segment (i.e., an inner casing segment) without cutting a second casing segment (i.e., an outer casing segment). U.S. Pat. No. 7,762,330, incorporated herein by reference to the extent not contradictory to embodiments herein, discloses examples of a cutting device 101, a packer 105, and a stabilizer 106 that may be used according to embodiments disclosed herein.

Figure 2:
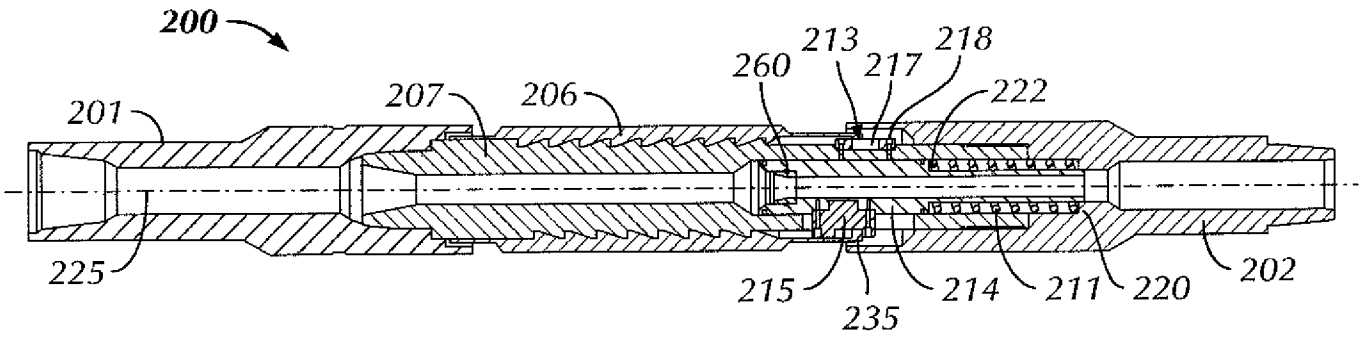
FIGS. 2-13 are various views of spearing devices according to embodiments of the present disclosure.
Figure 3:
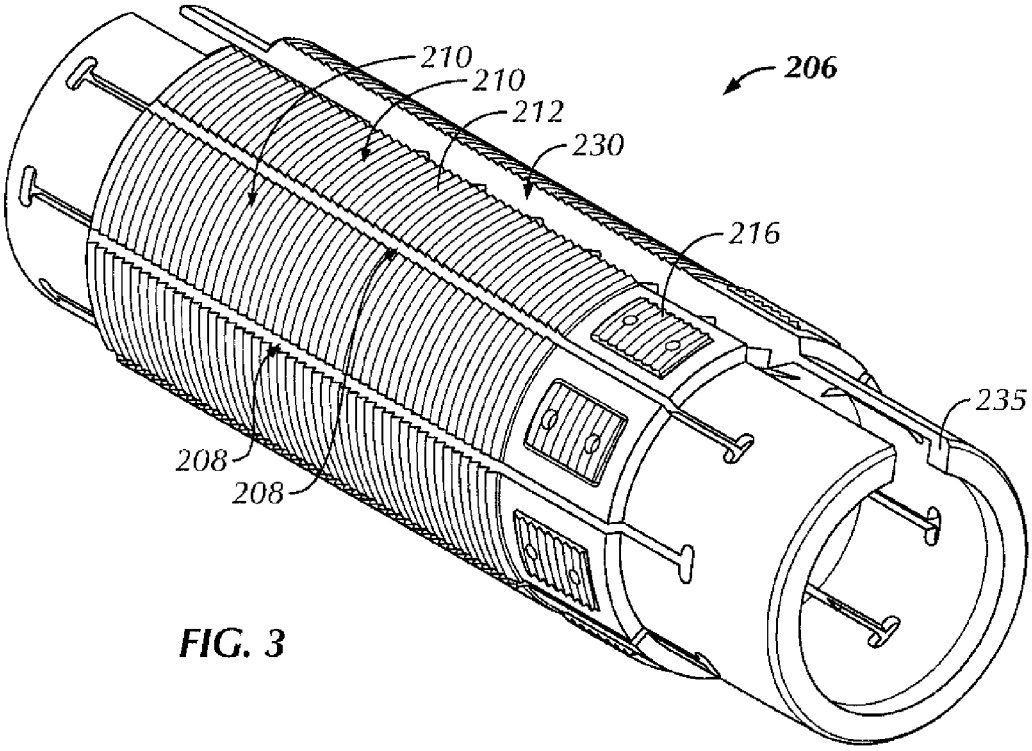

Referring to FIGS. 2 and 3, a spearing device according to embodiments herein is illustrated. Spearing device 200 may include a top sub 201 and a bottom sub 202. A mandrel 207 may be coupled to the top sub 201 and the bottom sub 202, stationary with respect to the top and bottom subs 201, 202 during operation of the spearing device 200. In some embodiments, the mandrel 207 may be threadedly connected to the top sub 201 and the bottom sub 202, stationary with respect to the top and bottom subs 201, 202 during operation of the spearing device 200.

Disposed circumferentially about the mandrel 207 is a grapple 206. Grapple 206 may include one or more axial slots 208 defining grapple members 210. At least a portion of the exterior surface of grapple members 210 includes wickers 212, 216 (FIG. 3) for engagement of the casing when the grapple members 210 are expanded. In some embodiments, grapple members 210 include wickers 212 biased in an upward direction to aid in lifting the casing from the wellbore. Grapple members 210 may also include wickers biased in a downward direction, minimizing slippage of the grapple relative to the casing during a jarring operation and aiding with re-cock of the jar, for example. This wicker design, when the grapple members 210 are engaged with the casing, allows application of axial force in both directions, as may be required by casing pulling, jarring operations, and jar re-cocking.

A portion of the outer surface of mandrel 207 is corrugated. Similarly, a portion of the inner surface of grapple members 210 is correspondingly corrugated. The respective corrugated surfaces may include ramps (non-helical) or buttress threads (helical), for example; use of threads may advantageously provide for rotational jerking of the spearing device. The corrugated surfaces may provide for axial and rotational movement of the grapple 206 along the corrugated outer surface of the mandrel 207. Axial movement of the grapple 206 relative to mandrel 207 results in expansion and contraction of the grapple members 210 due to the corrugated surfaces.

The design of grapple 206 may depend on the type of corrugated surfaces used. For example, helical buttress threads may provide for use of a one-piece grapple 206, where, as illustrated in FIG. 3, a lengthwise axial slot 230 may allow grapple 206 to flex when the grapple members are expanded. The buttress threads may also allow for ease in assembly. Where the corrugated surfaces are ramps, a multi-piece grapple 206 may be required (e.g., two half-ring sections).

A piston 214 is slidably disposed within mandrel 207 and/or bottom sub 202. Piston 214 is operatively coupled to grapple 206 via activation dogs 215, where the respective portions of the activation dogs may push or pull on shoulder 235 of grapple 206. Movement of piston 214 in an axial direction thus provides for expansion and contraction of grapple members 210. A spring 211 is also provided, operative with piston 214 and biasing the grapple 206 toward a contracted or collapsed position. As illustrated, spring 211 abuts a shoulder 220 of bottom sub 202 and a shoulder 222 of piston 214, and is in a biased, uncompressed condition.

Expansion of the grapple members 210 may be provided by a hydraulic activation system. For example, fluid flow is provided to spearing device 200 via throughbore 225. The fluid flow passes through top sub 201 and mandrel 207 and enters nozzle 260, resulting in applied pressure to a top surface of piston 214. The applied pressure pushes piston 214 downward, compressing spring 211, pulling grapple 206 axially with respect to mandrel 207 via activation dogs 215, and expanding the grapple members 210 to engage an inner surface of casing to be removed, where the engagement provides a firm grip for the tool with the casing to facilitate the retrieval of the cut casing segment from the wellbore. When the hydraulic pressure is reduced, spring 211 decompresses and moves the grapple 206 upward, retracting grapple members 210 and disengaging from the casing wall.

Alternatively, the spring 211 may be positioned above the piston and biased toward a compressed condition, where activation of the piston may pull on spring 211 and deactivation of the system may result in the spring compressing, pulling on the piston and collapsing the grapple members.

Spearing device 200 may also include an anti-rotation locking system 213, which may include one or more shear dogs 217 and shear screws 218, among other components. To avoid rotation of grapple 206 relative to mandrel 207, a shear dog 217 may be bolted to the mandrel 207 and disposed within a longitudinal slot 230 in grapple 206. In some embodiments, the shear dog 217 may be coupled to the mandrel 207 and disposed within a longitudinal slot 230 in grapple 206. Shear dog 217 incorporates an intentionally weakened face which can be sheared by application of right-hand (or alternatively left-hand) rotation of mandrel 207, such as in the event of a grapple 206 "freeze" that cannot be released by conventional application of downwards force. Anti-rotation locking system 213, when engaged, may prevent the grapple 206 from rotating when fully engaged with the casing. In some instances, however, it may be desirable to rotate grapple 206, such as to free the spearing device 200 from the casing or other instances as readily envisionable by one skilled in the art. Thus, when disengaged (i.e., sheared), anti-rotation locking system 213 may provide for rotation of the grapple 206, with typically less than 360 degrees of permitted rotation. The ability to unlock the rotatability of the grapple 206 may thus provide significant advantages during casing removal operations.

Referring now to FIGS. 4-13, a spearing device according to other embodiments herein are illustrated. Spearing device 400 may include a top sub 401, bottom sub 402, spring 411, piston 414, mandrel 407, grapple 406 (including grapple members and wickers (not illustrated)), activation dogs 415, throughbore 425, and anti-rotation locking system 413, each as described above with respect to FIGS. 2 and 3.

Spearing device 400 further includes a nozzle assembly 460, disposed on a proximal end of piston 414 and including a nozzle carrier 462 partially axially spaced above piston 414, a Bellville stack 464, and a nozzle 466. Spearing device 400 also includes a ratchet locking assembly 470, disposed in the central bore of the top sub 401 and coupled with the top sub 401. In some embodiments, the ratchet locking assembly 470 is threadedly connected with the top sub 401. Locking assembly 470 may include an outer sleeve 472, an intermediate sleeve 474, an inner sleeve 476, an end cap 478, and a ratchet mechanism 480, among other components as will be described below.

An upper end portion 477 of inner sleeve 476, or a portion thereof, may be disposed within the intermediate sleeve 474 and may include wickers (not illustrated) on an outer surface thereof. Inner sleeve 476 extends axially through mandrel 407, the lower end portion 479 (FIG. 4) of the inner sleeve being disposed proximate nozzle assembly 460.

Figure 10B:
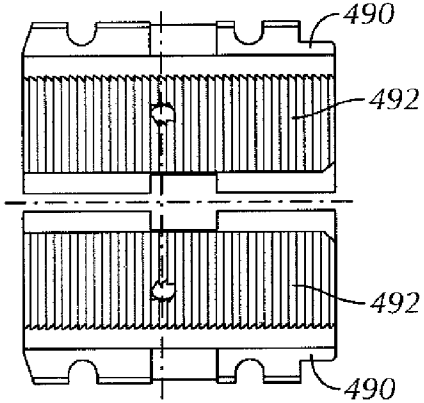
Figure 10A:
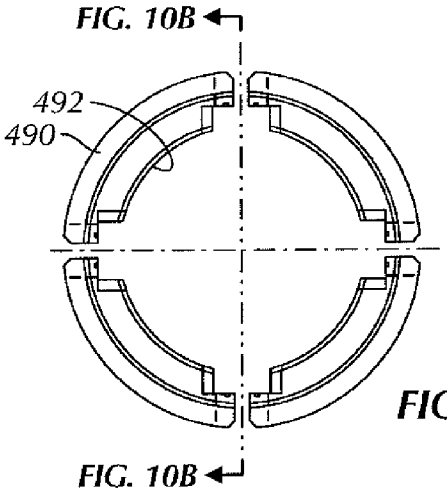
Figure 10C:
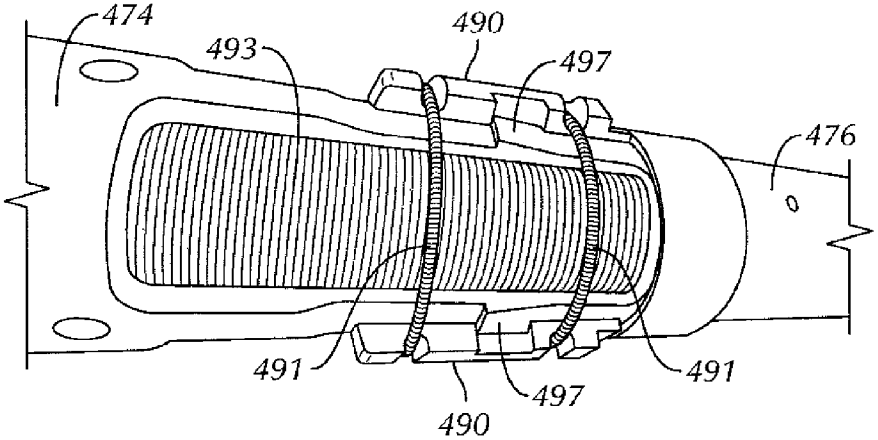

Ratchet mechanism 480 may be disposed between overlapping portions of the inner and intermediate sleeves 476, 474. Ratchet mechanism 480 engages the wickers of the inner sleeve 476 and allows downward axial movement of inner sleeve 476 but prevents upward axial movement of inner sleeve 476. Ratchet mechanism 480 may include a split ring 490 that includes inner ratchet teeth 492, such as illustrated in FIGS. 10A and 10B, retained by circumferential garter springs 491, for engaging the corresponding wickers 493 on inner sleeve 476 (FIG. 10C). The wickers are lengths of thread-like members that are tapered in only one direction. Thus, engagement between ratchet rings 490 and the wickers of inner sleeve 476 allows inner sleeve 476 to move in only one direction with respect to mandrel 407.

Figure 4:
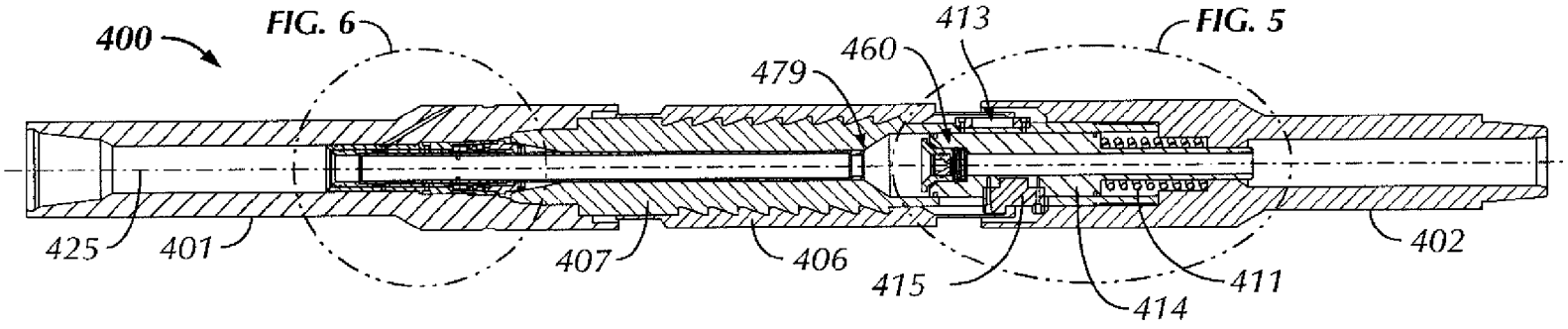
Figure 5:
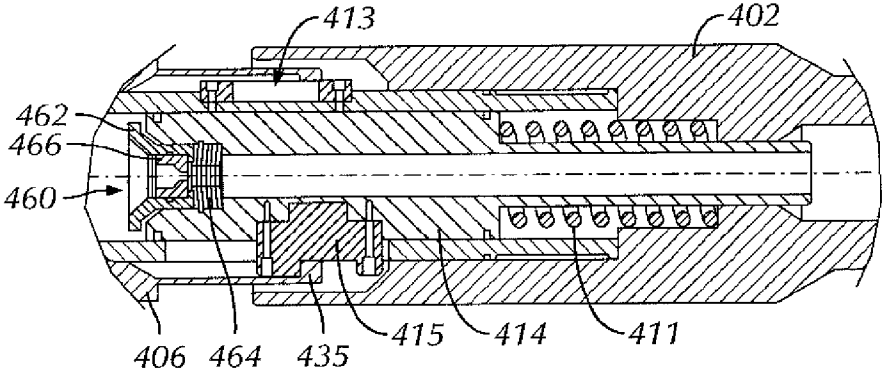
Figure 6:
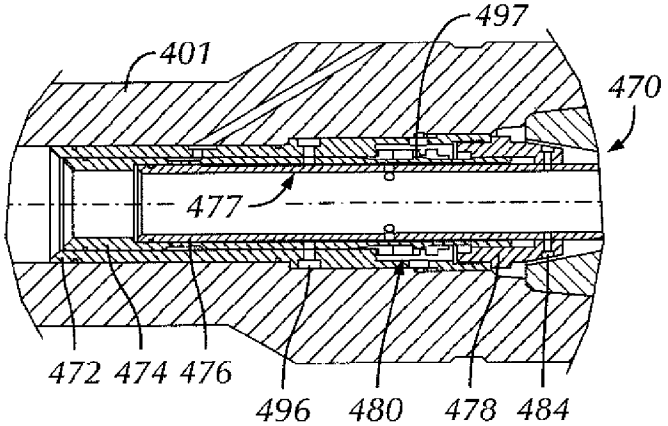
Figure 7:
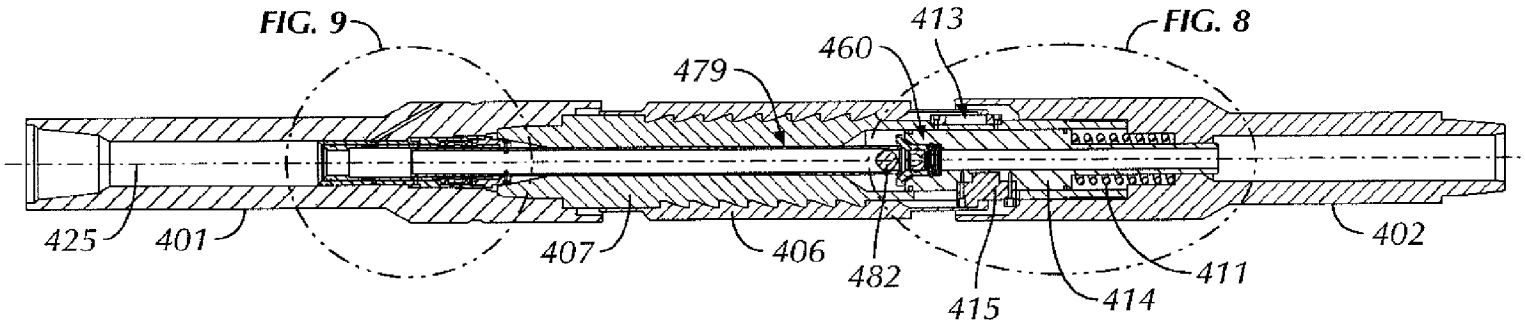
Figure 9:
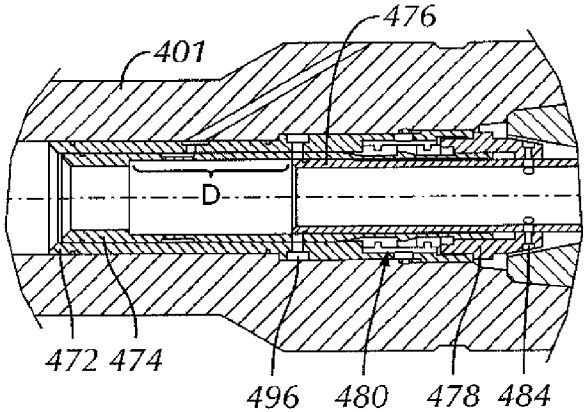
Figure 8:
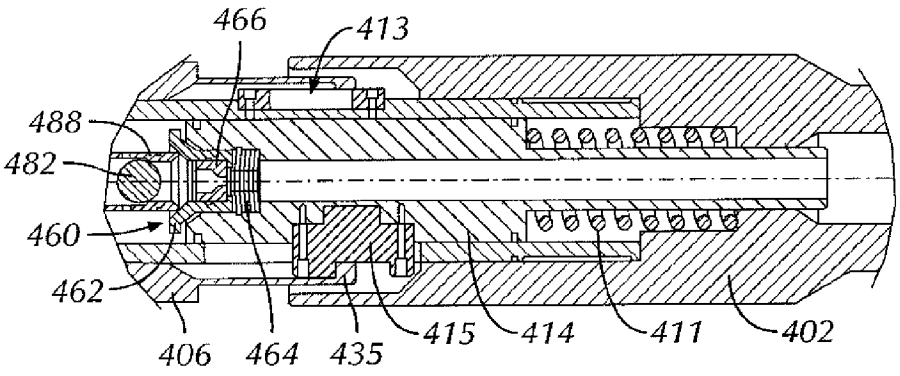

As illustrated in FIGS. 4-6, the spearing device is in a non-activated state. When spearing device 400 is to be used to hold and retrieve a piece of casing, such as retrieval to the surface, it may be desired or necessary to engage the holding ratchet mechanism 480. This is performed by bleeding pressure from the tool string and hence the bottom hole assembly, inserting a "drop ball" at surface and pumping this ball 482 through the tool string to spearing device 400, as illustrated in FIGS. 7-9. Once the ball has seated within the lower end portion of the inner sleeve 476, fluid pressure is applied to the spearing device 400, resulting in the ball 482 and hence the ratchet mandrel (inner sleeve 476) being forced downwards a distance D; this applied force results in the shearing of ratchet mandrel shear screws 484 (FIGS. 6 and 9). Prior to the ball drop, the spearing device may be hydraulically activated and deactivated as described above with respect to FIGS. 2 and 3; shearing of shear screws 484 as a result of the ball drop activates the ratchet locking mechanism.

The downward movement of ball 482 and ratchet mandrel 476 continues through the unidirectional wicker profile of the ratchet mechanism 480, which may include retaining blocks or ratchet rings 490 retained by circumferential garter springs 491 (FIGS. 10A-10C) that allow radial movement sufficient to allow the ratchet mandrel 476 and corresponding ratchet retaining rings 490 with wicker profiles 492 to pass over each other and then snap back into retention position after each wicker tooth length.

Once inner sleeve 476 has moved sufficiently to come into contact with the nozzle carrier 462, this effectively blocks the nozzle 466 and thus restricts fluid flow through the tool. Continued application of static pressure pushes the ball 482, inner sleeve 476, and nozzle carrier 462 downwards, thereby loading the Bellville spring stack 464, and, in turn directly mechanically pushing the piston 414 and activation dogs 415 into contact with lower lip 435 of grapple 406 and drawing it downwards along mandrel 407, thereby radially expanding the grapple 406 into contact with the casing as per the "pressure only" activation process described earlier. In addition to this directly applied mechanical force, fluid ports 488 above the drop ball's position in the inner sleeve 476 allows fluid pressure to be applied to the upper face of the piston assembly (piston 414, and nozzle carrier 462), thereby resulting in an effective activation force, matching and possibly exceeding that of the fluid set engagement described above with respect to FIGS. 2 and 3.

The purpose of the Bellville stack 464 is to prevent mechanical lockup of ratchet mandrel 476 and nozzle carrier 462 relative to piston assembly (piston 414, activation dogs 415, etc.) and hence, through transmission, grapple 406 and in turn the casing. This is required in order for the ratchet release mechanism to function properly (described below).

Figure 11:
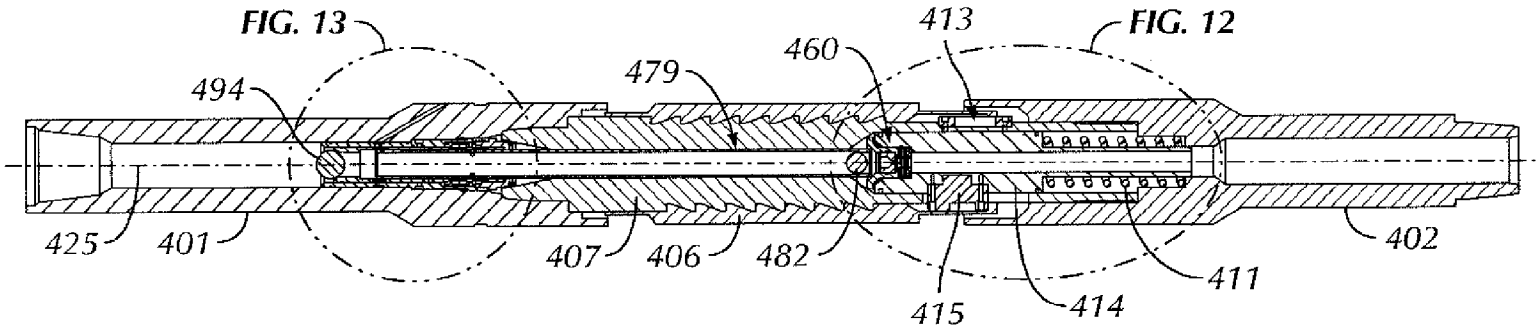
Figure 13:
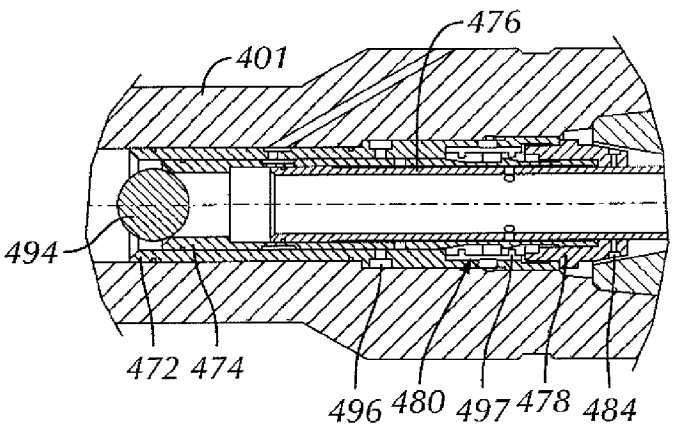
Figure 12:
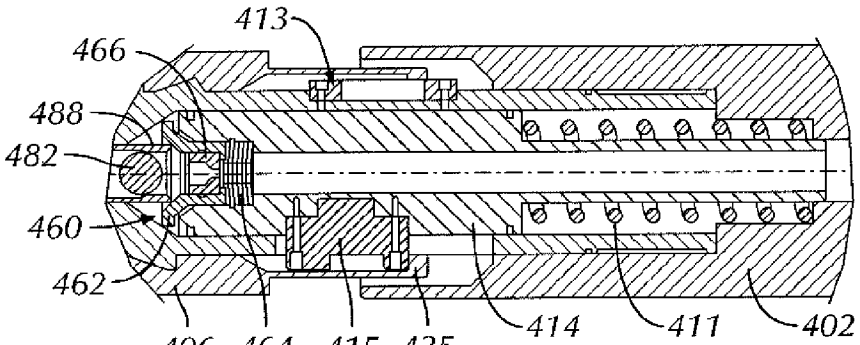

Referring now to FIGS. 11-13, when the spearing device 400 is to be released after "activation with ratchet" as described above (i.e., deactivated), a second, larger diameter drop ball 494 is to be "dropped" into the tool string and allowed to come into contact with the ratchet release sleeve (intermediate sleeve 474), as illustrated in FIG. 13.

Upon pressurization of the tool string and in turn application of fluid pressure to second ball 494, sufficient force is applied to the ratchet release sleeve 474 to shear the ratchet release shear screws 496 (see FIGS. 6 and 13) coupling outer sleeve 472 and intermediate sleeve 474. Once this occurs, the ratchet release sleeve 474 moves downward, bringing a release wedge profile feature 497 (integral with ratchet release sleeve 474) into contact with the corresponding ratchet rings/retaining blocks 490 internal wedge profiles (not shown). Continued downward travel of the ratchet release sleeve 474 forces the ratchet rings 490 to move outwards radially against the circumferential retaining garter springs 491 a distance that allows clearance between the retaining rings 490 and ratchet mandrel 476 wicker profiles. The resultant de-meshing of the wicker profile features allows free upward movement of the inner sleeve 476 causing the spring, piston, and grapple to return to the relaxed position, thereby disengaging grapple 406 from the casing, and thus releasing the casing.

During casing recovery operations, varied configurations of bottom hole assemblies including the above-described components may be used. Referring back to FIG. 1, the operation of downhole tool assembly 100 during casing recovery operations will be described in detail. Initially, downhole tool assembly 100 is disposed in a wellbore, wherein downhole tool assembly 100 includes at least a cutting device 101, a spearing device 102, and a jarring device 104. As described above, downhole tool assembly 100 may also include various other components, such as stabilizers 106, packers 105, and/or jarring accelerators 103.

In one embodiment, downhole tool assembly 100 is disposed in a wellbore, and lowered to a portion of the wellbore where a casing cut is desirable. When downhole tool assembly 100 reaches the preferred casing section, cutting device 101 is activated by, for example, radio frequency transmission, ball drop actuation, pressure actuation, pressure pulse from the surface to the tool, such as through measurement while drilling tools, or any other actuation method known to those of ordinary skill in the art. Activation of cutting device 101 allows for a first casing segment to be cut. After the first casing segment is cut, cutting device 101 is deactivated, and spearing device 102 is activated. Spearing device 102 is engaged with the cut casing segment, and jarring device 104 is activated, so as to free the first casing segment. Because spearing device 102 is engaged with the first casing segment, downhole tool assembly 100 may be pulled up, and the casing segment removed from the wellbore.

In other embodiments, after the first casing segment is cut and spearing device 102 is engaged with the cut casing segment, cutting device 101 may be re-activated, and a second casing cut may be made. In certain embodiments, two casing cuts may be required, such that upon jarring the casing segment, the casing segment is freed. To increase the precision of the casing cuts, stabilizers 106 may be disposed on downhole tool assembly 100 to centralize cutting device 101 within the wellbore. By centralizing cutting device 101, the individual cutters of cutting device 101 may be controlled, such that a preferred depth of cut may be maintained. Additionally, centralizing cutting device 101 may decrease the wear on the individual cutters, thereby increasing the life of cutting device 101.

Figure 14:
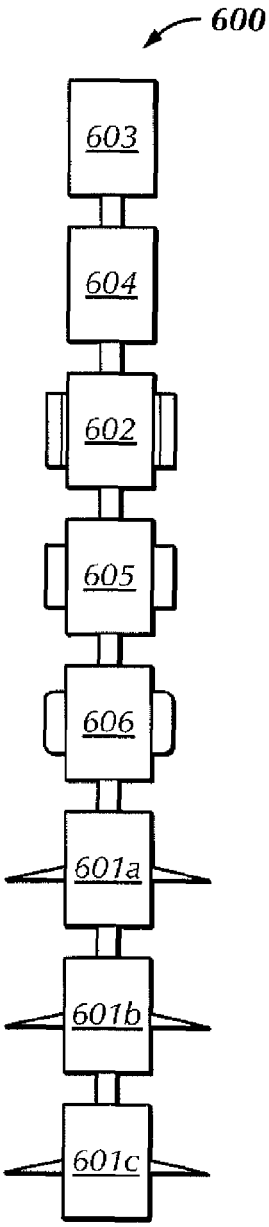
FIGS. 14-16 are schematic representations of downhole tool assemblies according to embodiments of the present disclosure.

Referring to FIG. 14, a downhole tool assembly 600 according to an alternate embodiment of the present disclosure is shown. In this embodiment, downhole tool assembly includes multiple cutting devices 601*a*, 601*b*, 601*c*, a spearing device 602, and a jarring device 604. As described with respect to FIG. 1, fishing tool assembly 600 may also include additional components, such as jarring accelerators 603, packers 605, and/or stabilizer(s) 606.

In this embodiment, fishing tool assembly 600 may be disposed in a wellbore and activated similar to the activation of downhole tool assembly 100 of FIG. 1. However, after a first casing segment is cut, and cutting device 601*a* is deactivated, fishing tool assembly 600 may either be raised or lowered into the wellbore to a different depth, and additional cuts may be made. For example, in one embodiment, cutting device 601*a* may be activated and deactivated so as to make a number of cuts, such as 3 or more cuts. After a number of cuts, the cutters of cutting device 601*a* may be worn such that additional cuts can not be made. However, rather than remove fishing tool assembly 600 from the wellbore so that the cutters and/or cutting device 601*a* may be replaced, cutting device 601*a* may be deactivated, and cutting device 601*b* may be activated, such that additional cuts may be made. Those of ordinary skill in the art will appreciate that the process of deactivating one of cutting devices 601*a*, 601*b*, or 601*c* and activating a different cutting device 601*a*, 601*b*, or 601*c* may occur in any order. For example, in certain embodiments, the lowest cutting device 601*c* may be activated first, while in other embodiments, cutting device 601*a* or 601*b* may be activated first. The order of activation of cutting devices 601*a*, 601*b*, and 601*c* will depend on the requirements of the casing cutting operation, as well as the depth of the casing segments within the wellbore.

Multiple cutting devices 601 may allow for multiple casing cuts to be made in a single trip of the tool string. Cutters of cutting devices 601 often wear down after two to three cuts. As such, the tool string would have to be tripped after two to three cuts. However, downhole tool assembly 600 may be capable of making multiple cuts, such as twelve or more cuts, thereby decreasing the number of trips of the tool string required to cut casing segments from the wellbore. In other embodiments, multiple cutting devices 601 may serve as redundant cutting devices, such that if one of the cutting devices 601 loses functionality or if the cutters of a first cutting device wear down prematurely, a second cutting device may be used. Those of ordinary skill in the art will appreciate that depending on the requirements of the casing cutting operation, the number of cutting devices 601 may vary. As such, bottom hole assemblies having one, two, three, four, or more cutting devices are within the scope of the present disclosure.

Figure 15:
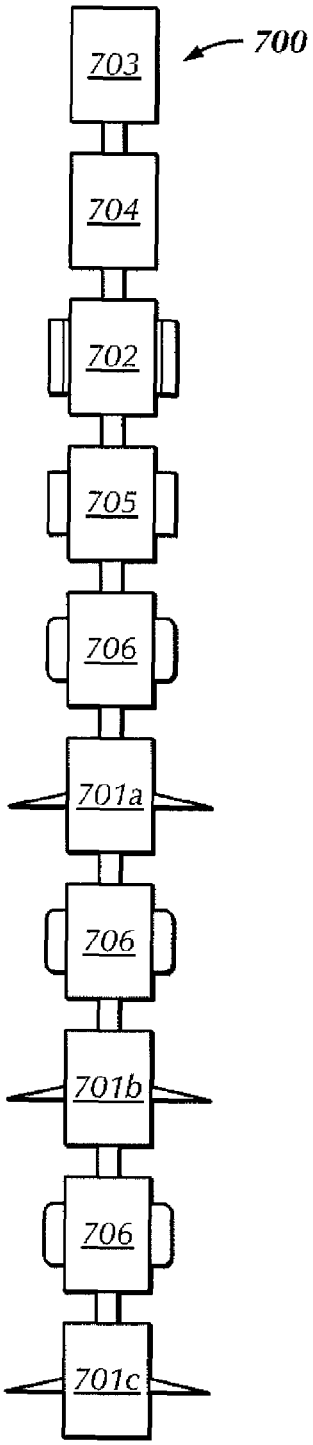

Referring to FIG. 15, a downhole tool assembly 700 according to one embodiment of the present disclosure is shown. In this embodiment, downhole tool assembly 700 includes multiple cutting devices 701*a*, 701*b*, and 701*c*, a spearing device 702, and a jarring device 704. Downhole tool assembly 700 also includes various optional components, such as a jarring accelerator 703, packer(s) 705, and a plurality of stabilizers 706.

In this embodiment, the configuration of stabilizers 706 may allow for near cutting device centralization during activation of any of cutting devices 701*a*, 701*b*, and/or 701*c*. As illustrated, stabilizers 706 are located at least above each of cutting devices 701. As such, as cutting devices 701 are activated, the tool string may be centralized in a location close to cutting device 701. By increasing stabilization and thus centralization of the tool string close to the individual cutting devices, the precision of cuts made by each cutting device 701 may be increased. Those of ordinary skill in the art will appreciate that the spacing of the individual stabilizers 706 will vary based on the type and/or size of casing being cut and the parameters of the downhole tool assembly 700. However, by decreasing the space between cuttings devices 701 and stabilizers 706, the centralization of the individual cutting devices 701 may be increased. Additionally, in certain embodiments, it may be beneficial to have stabilizers 706 disposed along the tool string both above and below cutting devices 701.

Figure 16:
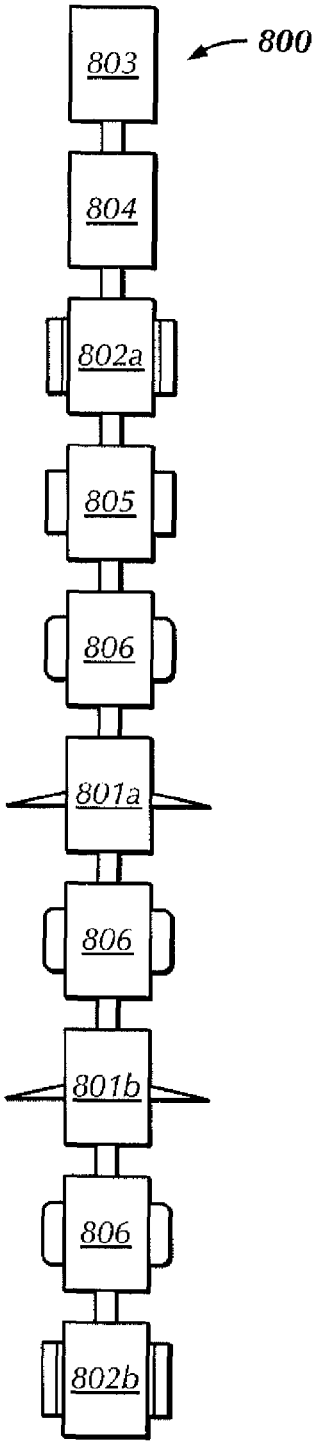

Referring to FIG. 16, a downhole tool assembly 800 according to one embodiment of the present disclosure is shown. In this embodiment, downhole tool assembly 800 includes multiple cutting devices 801*a* and 801*b*, multiple spearing devices 802*a* and 802*b*, and a jarring device 804. Downhole tool assembly 800 also includes various optional components, such as a jarring accelerator 803, packer(s) 805, and a plurality of stabilizers 806.

Downhole tool assembly 800 includes multiple spearing devices 802*a* and 802*b*, thereby increasing the number of cut casing segments that may be removed from the wellbore in a single trip. Downhole tool assembly 800 may thus be used in a cutting operation wherein cutting device 801*a* is activated, and a first casing segment is cut. Spearing device 802*a* may then be activated, thereby engaging spearing device 802*a* with the first casing segment, and jarring device 804 may be activated to free the cut casing segment from the wellbore. Subsequently, second cutting device 801*b* may be activated, and a second casing segment may be cut. Spearing device 802*b* may then be activated, so as to engage the cut casing segment. Jarring device 803 may then be reactivated, and the second casing segment may be freed from the wellbore. The above described method of cutting, spearing, and jarring may be repeated as many times as the cutters on individual cutting devices 801 allow. As such, multiple casing segments may be cut, speared, and removed from the wellbore in a single trip.

Those of ordinary skill in the art will appreciate that the order of operation of the individual components may be varied, without departing from the scope of the present disclosure. For example, in one embodiment, cutting device 801*a* may be activated, and a first casing cut made. Cutting device 801*a* may then be deactivated, and the tool string lowered axially within the wellbore. Cutting device 801*a* may then be reactivated, and a second casing cut may be made. This process of making multiple casing cuts may be repeated for the life of the cutters on cutting device 801*a*. After the desired number of casing cuts are made, spearing device 802*a* may engage one or more of the cut casing segments, and jarring device 804 may be activated to help free the casing cuts.

In other embodiments, after the plurality of casing cuts by cutting device 801*a* have been made, cutting device 801*b* may be activated, and a plurality of additional casing cuts may be made. Similar to the function of cutting device 801*a*, cutting device 801*b* may be activated and deactivated until the desired number of casing cuts has been made. After all of the casing cuts have been made by both cutting devices 801*a* and 801*b*, one or more of spearing devices 802*a* and 802*b* may be activated to engage the cut casing segments. In one embodiment, both spearing devices 802*a* and 802*b* may be activated, while in other embodiments only one of spearing devices 802*a* or 802*b* may be required to allow for the removal of the cut casing segments from the wellbore. Those of ordinary skill in the art will appreciate that it may only be necessary to engage the lowest axial spearing device, in this embodiment 802*b*, when removing the casing segments. Because the higher axial casing segments will be pulled up to the surface of the wellbore as the lowest axial casing segment is pulled upwardly, only one spearing device 802*b* may be required to remove multiple casing segments. However, in certain embodiments, it may be beneficial to engage multiple spearing devices 802 with the cut casing segments so as to increase the contact area between the spearing device 802 and the casing being removed. By increasing the surface area of the contact between the spearing device 802 and the casing, more casing may be removed from the wellbore in a single trip.

Fishing tool assemblies as described above include a spearing device, or grapple, that is configured to engage drill pipe or casing. The spearing device may be internal to the cylindrical body of a cutting tool, or in other embodiments, may be a separate component of a fishing tool assembly. In such an embodiment where the spearing device is a separate component of a fishing tool assembly, the spearing device may be disposed axially upward of a cutting tool, and may engage the drill pipe or casing before, during, and/or after the cutting operation. Thus, drill pipe may be held in place during operation, and as the cutting tool assembly is removed from the wellbore, the cut section of the drill pipe may also be removed from the wellbore.

Any of the above described embodiments may allow for multiple casing segments to be removed from a wellbore in a single trip. The order of operation of specific embodiments of the present disclosure may vary according to the requirements of the cutting operation. For example, in certain embodiments, multiple casing cuts may be made, followed by a single spearing and jarring. In other embodiments, multiple casing cuts may be followed by multiple spearing and jarring. Accordingly, all of the casing cuts may be made initially, followed by spearing the lowest axial cut casing segment, jarring one or more of the segments, and then removing the freed casing segments from the wellbore. Those of ordinary skill in the art will appreciate that each cut casing segment may be jarred loose separately. In other embodiments, it may be beneficial to cut a desired number of casing segments, spear the segments, and then cut additional segments. In such an embodiment, multiple spearing devices may facilitate the cutting and removal of the cut casing segments from the wellbore.

Advantageously, embodiments of the present disclosure may allow for casing segments to be cut, speared, and removed from a wellbore in a single trip of the tool string. By providing multiple cutting devices that may be sequentially activated by the use of, for example, radio frequency transmission, sequentially sized ball drop actuation, pressure pulse actuation, and/or pressure thresholds, a plurality of casing segments may be cut, speared, and removed from the wellbore. Such activation may be remotely and selectively controlled from the rig floor. By removing multiple casing segments in a single trip, valuable time may be saved in slot recovery operations. Additionally, by decreasing the number of trips of the tool string to cut and recover casing segments, the cost of a slot recovery operation may be decreased.

The hydraulically actuated spears disclosed herein, such as illustrated in FIGS. 2 and 4, may provide for a greater expansion of the grapple members, allowing an increased initial clearance, and facilitating insertion of the tool assembly within the casing. The greater expansion may also provide for use of an improved teeth (wickers) design, and for increased gripping forces, allowing a greater weight carrying capacity as compared to mechanically activated spearing devices, and facilitating removal of larger and/or more sections of casing in a single trip. For example, in the case of upward pulling, the force applied is directly transmitted from the casing to top sub 201 and in turn to mandrel 207. This force pulls mandrel 207 upward relative to the now "stuck" grapple 206, thereby increasing the radial expansion forces acting upon the grapple, and thus increasing the gripping force between the grapple wickers and the casing.

While the disclosure includes a limited number of embodiments, those skilled in the art, having benefit of this disclosure, will appreciate that other embodiments may be devised which do not depart from the scope of the present disclosure. Although only a few example embodiments have been described in detail above, those skilled in the art will readily appreciate that many modifications are possible in the example embodiments without materially departing from this invention. Accordingly, all such modifications are intended to be included within the scope of this disclosure. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed:

1. A spearing device for use in removing casing from a wellbore, comprising:

a top sub;

a bottom sub;

a mandrel coupled to the top sub and bottom sub and having an outer surface, at least a portion of which is corrugated;

a grapple including one or more grapple members having a correspondingly corrugated inner surface and at least a portion of an outer surface of the grapple members including wickers for engaging an interior surface of the casing, wherein the grapple is configured to (i) axially and rotationally move along the corrugated outer surface of the mandrel and (ii) expand and collapse the grapple members responsive to axial movement relative to the mandrel;

a piston slidably disposed within the mandrel and operatively coupled to the grapple; and a spring operative with the piston and biasing the grapple toward a collapsed position;

wherein:

responsive to an increase in hydraulic pressure, the piston compresses the spring and axially moves the grapple, expanding the grapple members; and responsive to a subsequent decrease in hydraulic pressure, the spring decompresses and axially moves the grapple, collapsing the grapple members.

2. The spearing device of claim 1, further comprising an anti-rotation locking system to limit rotation of the grapple relative to the mandrel.

3. The spearing device of claim 1, wherein at least a portion of the wickers are biased in an upward direction to aid in lifting the casing and at least another portion of the wickers are biased in a downward direction to minimize slipping of the grapple during a jarring operation or re-cocking of a jar.

4. The spearing device of claim 1, wherein the corrugated outer surface of the mandrel and the corresponding corrugated inner surface of the grapple each comprise at least one of ramps and buttress threads.

5. The spearing device of claim 1, further comprising a ratchet locking system including:

a stationary outer sleeve disposed within the top sub;

an intermediate sleeve; and an inner sleeve having an upper end portion and a lower end portion, a portion of the upper end portion being disposed within the intermediate sleeve and having wickers on an exterior portion thereof, the lower end portion being disposed within the mandrel and operative with the piston;

a ratchet mechanism disposed between overlapping portions of the inner and intermediate sleeves, configured to engage the wickers of the inner sleeve and allow downward axial movement of the inner sleeve but prevent upward axial movement of the inner sleeve; and a ratchet release mechanism configured to disengage the ratchet mechanism from the wickers of the inner sleeve and allow upward movement of the inner sleeve.

6. The spearing device of claim 5, further comprising one or more shear screws configured to limit movement of the inner sleeve with respect to the outer sleeve, wherein the lower end portion of the inner sleeve is configured to receive a first drop ball and to move downward due to the resulting restricted fluid flow through the mandrel, thereby shearing the one or more shear screws, ratcheting the upper end portion of the inner sleeve with the ratchet mechanism, and engaging an upper end portion of the piston or nozzle assembly to result in expansion of the grapple members.

7. The spearing device of claim 6, wherein the lower end portion of the inner sleeve comprises one or more nozzles to provide fluid flow to an upper end portion of the piston following receipt of the first drop ball.

8. The spearing device of claim 7, further comprising one or more shear screws configured to limit movement of the intermediate sleeve with respect to the outer sleeve, wherein an upper end portion of the intermediate sleeve is configured to receive a second drop ball and to move downward due to the resulting restricted fluid flow through the mandrel, thereby shearing the one or more shear screws and activating the ratchet release mechanism to result in upward movement of the piston and collapsing the grapple members.

9. A downhole tool for cutting and removing casing, the tool comprising:

a cutting device disposed on a tool string and configured to make at least one casing cut;

a spearing device disposed on the tool string and configured to engage and remove casing cut by the at least one cutting device;

wherein the spearing device includes:

a top sub;

a bottom sub;

a mandrel coupled to the top sub and bottom sub and having an outer surface, at least a portion of which is corrugated;

a grapple including one or more grapple members having a correspondingly corrugated inner surface and at least a portion of an outer surface of the grapple members including wickers for engaging an interior surface of the casing, wherein the grapple is configured to (i) axially and rotationally move along the corrugated outer surface of the mandrel and (ii) expand and collapse the grapple members responsive to axial movement relative to the mandrel;

a piston slidably disposed within the mandrel and operatively coupled to the grapple; and a spring operative with the piston and biasing the grapple toward a collapsed position;

wherein:

responsive to an increase in hydraulic pressure, the piston compresses the spring and axially moves the grapple, expanding the grapple members; and responsive to a subsequent decrease in hydraulic pressure, the spring decompresses and axially moves the grapple, collapsing the grapple members.

10. The tool of claim 9, the spearing device further comprising an anti-rotation locking system to limit rotation of the grapple relative to the mandrel, wherein the anti-rotation locking system comprises a shear dog coupled to the mandrel and disposed within a longitudinal slot in the grapple.

11. The tool of claim 9, wherein at least a portion of the wickers are biased in an upward direction to aid in lifting the casing and at least another portion of the wickers are biased in a downward direction to minimize slipping of the grapple during a jarring operation or re-cock of a jar.

12. The tool of claim 9, the spearing device further comprising a ratchet locking system comprising:

a stationary outer sleeve disposed within the top sub;

an intermediate sleeve;

an inner sleeve having an upper end portion and a lower end portion, a portion of the upper end portion being disposed within the intermediate sleeve and having wickers on an exterior portion thereof, the lower end portion being disposed within the mandrel and operative with the piston;

a ratchet mechanism disposed between overlapping portions of the inner and intermediate sleeves, configured to engage the wickers of the inner sleeve and allow downward axial movement of the inner sleeve but prevent upward axial movement of the inner sleeve; and a ratchet release mechanism configured to disengage the ratchet mechanism from the wickers of the inner sleeve and allow upward movement of the inner sleeve.

13. The tool of claim 12, further comprising one or more shear screws configured to limit movement of the inner sleeve with respect to the outer sleeve, wherein the lower end portion of the inner sleeve is configured to receive a first drop ball and to move downward due to the resulting restricted fluid flow through the mandrel, thereby shearing the one or more shear screws, ratcheting the upper end portion of the inner sleeve with the ratchet mechanism, and engaging an upper end portion of the piston or nozzle assembly to result in expansion of the grapple members.

14. The tool of claim 13, wherein the lower end portion of the inner sleeve comprises one or more nozzles to provide fluid flow to an upper end portion of the piston following receipt of the first drop ball.

15. The tool of claim 14, further comprising one or more shear screws configured to limit movement of the intermediate sleeve with respect to the outer sleeve, wherein an upper end portion of the intermediate sleeve is configured to receive a second drop ball, move downward due to the resulting restricted fluid flow through the mandrel, shearing the one or more shear screws and activating the ratchet release mechanism to result in upward movement of the piston and collapsing the grapple members.

16. A method of removing casing from downhole, comprising:

disposing a downhole tool assembly downhole, the downhole tool assembly including a first cutting device and a first spearing device, wherein the spearing device includes:

a top sub;

a bottom sub;

a mandrel coupled to the top sub and bottom sub and having an outer surface, at least a portion of which is corrugated;

a grapple including one or more grapple members having a correspondingly corrugated inner surface and at least a portion of an outer surface of the grapple members including wickers for engaging an interior surface of the casing, wherein the grapple is configured to (i) axially and rotationally move along the corrugated outer surface of the mandrel and (ii) expand and collapse the grapple members responsive to axial movement relative to the mandrel;

a piston slidably disposed within the mandrel and operatively coupled to the grapple; and a spring operative with the piston and biasing the grapple toward a collapsed position;

wherein:

responsive to an increase in hydraulic pressure, the piston compresses the spring and axially moves the grapple, expanding the grapple members; and responsive to a subsequent decrease in hydraulic pressure, the spring decompresses and axially moves the grapple, collapsing the grapple members activating the first cutting device;

cutting a first casing segment;

deactivating the first cutting device;

activating the first spearing device;

engaging the first spearing device with the first casing segment;

removing the first casing segment.

17. The method of claim 16, further comprising:

cutting a second casing segment; and removing the first casing segment and the second casing segment from downhole in a single trip.

18. The method of claim 16, further comprising at least one of:

activating a stabilizer in the wellbore to centralize the cutting device in the casing;

activating a jarring device to free the first casing segment from the wellbore.

19. The method of claim 18, wherein the outer surface of the grapple comprises wickers biased in an upward direction and wickers biased in a downward direction, the method further comprising re-cocking the jarring device while the grapple is engaged with the casing.

20. The method of claim 16, wherein the spearing device further comprises an anti-rotation locking system including a shear dog coupled to the mandrel within a longitudinal slot in the grapple to limit rotation of the grapple relative to the mandrel, the method further comprising shearing the shear dog and rotating the grapple relative to the mandrel.

21. The method of claim 16, wherein the spearing device further comprises a ratchet lock/unlock system, the method further comprising:

inserting a first drop ball into the downhole tool assembly to lock the grapple in engagement with the casing;

inserting a second drop ball into the downhole tool assembly to unlock the grapple and disengage the grapple from the casing.

* * * * *